US008453654B2

(12) United States Patent
Munoz

(10) Patent No.: US 8,453,654 B2
(45) Date of Patent: Jun. 4, 2013

(54) HAIR VOLUMIZER AND METHOD OF USE

(76) Inventor: Toni Munoz, Dallas, TX (US)

( * ) Notice: Subject to any disclaimer, the term of this patent is extended or adjusted under 35 U.S.C. 154(b) by 0 days.

(21) Appl. No.: 13/180,317

(22) Filed: Jul. 11, 2011

(65) Prior Publication Data

US 2013/0014775 A1 Jan. 17, 2013

(51) Int. Cl.

| | |
|---|---|
| ***A45D 8/38*** | (2006.01) |
| ***A45D 8/00*** | (2006.01) |
| ***A41G 3/00*** | (2006.01) |

(52) U.S. Cl.
USPC ..... 132/106; 132/276; 132/53

(58) Field of Classification Search
USPC ..... 132/201, 273–276, 278, 280, 281, 132/53, 54, 106, 55
See application file for complete search history.

(56) References Cited

U.S. PATENT DOCUMENTS

| | | | | |
|---|---|---|---|---|
| 779,413 | A * | 1/1905 | Damon | 132/106 |
| 794,479 | A * | 7/1905 | Austin | 132/105 |
| 4,155,370 | A * | 5/1979 | Nemoto | 132/53 |
| 5,765,571 | A * | 6/1998 | Dinnel | 132/210 |
| 5,813,418 | A | 9/1998 | Pillars | |
| 2006/0042644 | A1 * | 3/2006 | Martinelli et al. | 132/148 |

* cited by examiner

*Primary Examiner* — Todd Manahan
*Assistant Examiner* — Brianne Kalach
(74) *Attorney, Agent, or Firm* — Jackson Walker L.L.P.; Christopher J. Rourk

(57) ABSTRACT

An apparatus for hair care comprising an elongate foam body having tapered ends. A flexible core embedded within the foam body. Clips attached to the foam body, clips haying an open position and a closed position. Wherein the foam body is configured to be placed underneath a user's existing natural hair and to be covered by the user's existing natural hair when secured in position by the plurality of clips. Wherein the flexible core is configured to be adapted to a contour of the user's head.

15 Claims, 7 Drawing Sheets

HAIR VOLUMIZER AND METHOD OF USE

TECHNICAL FIELD

The present disclosure generally relates to hair care products, and more particularly to a hair volumizer and method of use.

BACKGROUND OF THE INVENTION

There have been many approaches to adding volume to hair, such as hair spray and hair products, hair clips, clip-in hair extensions, and teasing brushes. Each of these existing approaches has problems. For example, hair spray and hair products leave hair stiff and chemically damaged. Hair clips remain visible when used, and are also difficult to properly place. Clip-in hair extensions have other problems: they are difficult to place and must exactly match the color of the existing natural hair, they are relatively expensive, and they have to be treated like existing hair by washing and styling them. Teasing brushes break and irreversibly damage hair. As a result, although there are existing methods and devices on the market that add volume to hair, they fail to provide an easy and effective way to maintain volume, while achieving a natural look, and without causing damage to existing hair.

SUMMARY OF THE INVENTION

A hair volumizer and method of use that provides an easy way to lift and add volume to existing hair, in a way that appears natural, and without breaking or chemically damaging the existing hair. In particular, the disclosed hair volumizer can be employed without assistance from others and results in hair having more and longer lasting volume without the need for hair sprays and products, hair extensions, teasing brushes or other materials or devices that can damage the existing hair or leave it looking and feeling unnatural.

Other systems, methods, features, and advantages of the present disclosure will be or become apparent to one with skill in the art upon examination of the following drawings and detailed description. It is intended that all such additional systems, methods, features, and advantages be included within this description, be within the scope of the present disclosure, and be protected by the accompanying claims.

BRIEF DESCRIPTION OF THE SEVERAL VIEWS OF THE DRAWINGS

Aspects of the disclosure can be better understood with reference to the following drawings. The components in the drawings are not necessarily to scale, instead the emphasis is placed upon clearly illustrating the principles of the present disclosure. Moreover, in the drawings, like reference numerals designate corresponding parts throughout the several views, and in which.

DETAILED DESCRIPTION OF THE INVENTION

Figure 1A:
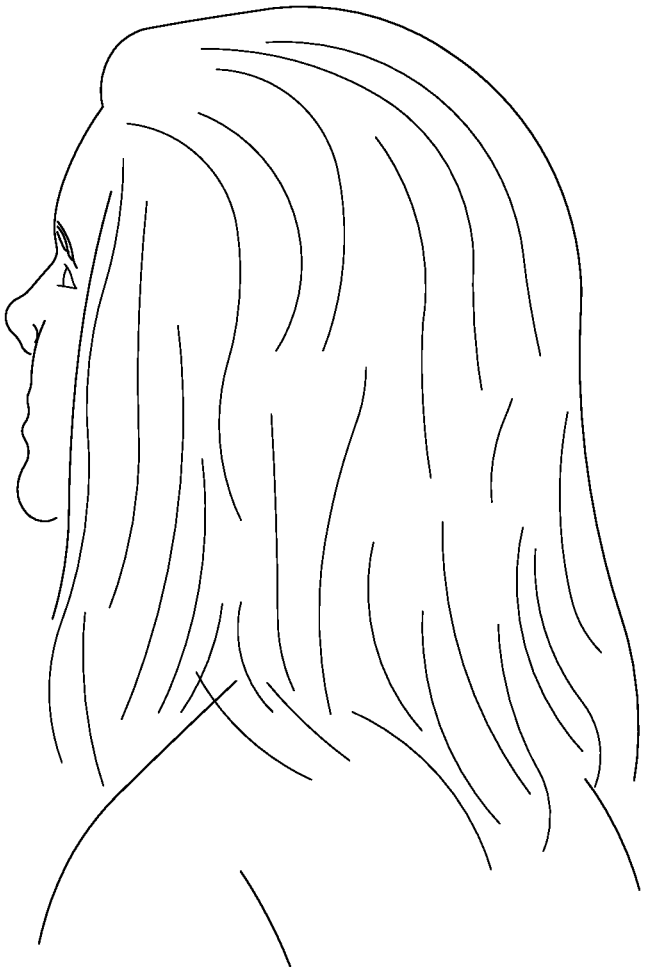
FIGS. 1A-1C show before and after views of the consumer using the hair volumizer in accordance with an exemplary embodiment of the present disclosure.

In the description that follows, like parts are marked throughout the specification and drawings with the same reference numerals. The drawing figures might not be to scale and certain components can be shown in generalized or schematic and identified by commercial designations in the interest of clarity and conciseness.

Figure 1C:
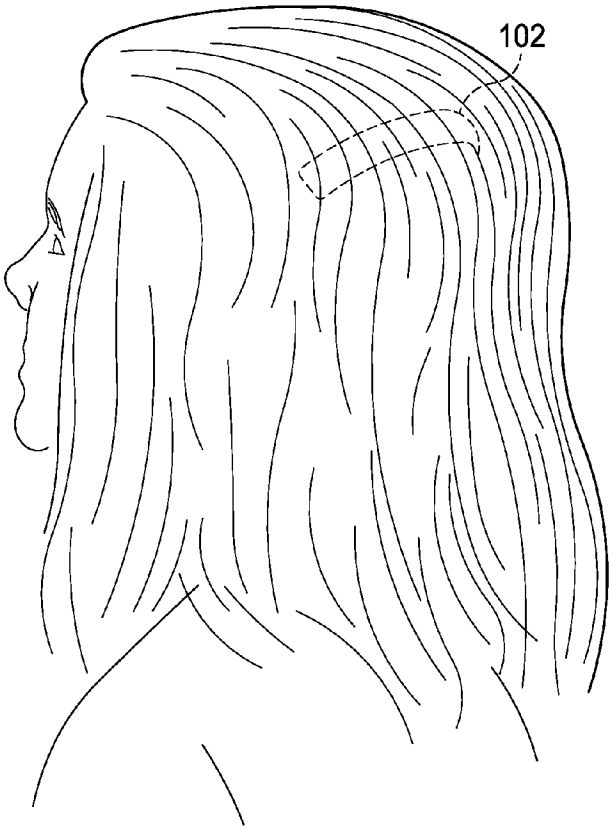
Figure 1B:
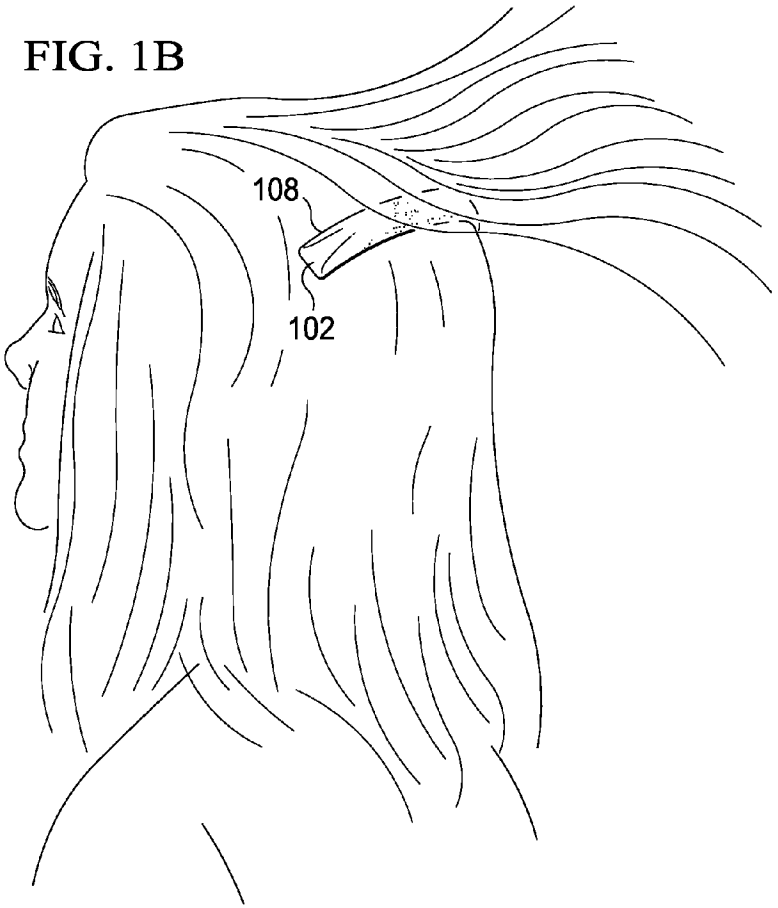

FIGS. 1A-1C show before and after views of a model using a hair volumizer 102 in accordance with an exemplary embodiment of the present disclosure. In FIG. 1, the model's hair is shown in a natural, unaltered style. To use hair volumizer 102, a lock of the hair is lifted and the hair volumizer 102 is clipped into place underneath the lifted lock of hair, as shown in FIG. 1B. The ends 108 of hair volumizer 102 are tapered and colored so as to blend in with the user's hair. The lifted lock of hair is then allowed to fall naturally over hair volumizer 102, resulting in an increase in the hair volume as shown in FIG. 1C.

The use of hair volumizer 102 as described above results in a number of advantages over existing devices and techniques for increasing hair volume. One advantage is that hair volumizer 102 can be easily placed into position by the user, with little or no assistance from others. In addition, hair volumizer 102 also bends and shapes to fit the contours of the user's head. Thus, unlike most hair products on the market, the use of hair volumizer 102 does not require assistance by a hair-care professional.

Another advantage of the present disclosure is that hair volumizer 102 adds volume to the user's natural existing hair without the need hair-stiffening compounds, such as hair-spray or chemical products that can chemically damage the existing hair. Hair extensions are hard to match the consumer's natural existing hair color and texture. With hair volumizer 102, the user's hair will thus look and feel completely natural, without taking too much time or the use of chemical products to apply.

Yet another advantage of the present disclosure is that hair volumizer 102 can be easily manipulated to conform to the user's head. As discussed in greater detail below, hair volumizer 102 includes a flexible core and foam polymer body that can be adapted to fit the contour of the user's head at the exact location where hair volumizer is installed. Unlike other clips or hair extensions, which are typically rigid and which may be difficult to place for that reason, hair volumizer 102 can bend easily, which facilitates both the placement of hair volumizer 102 and the appearance of hair volumizer 102 in use.

A further advantage of the present disclosure is that the use of hair volumizer 102 can reduce the need to repeatedly tease the user's natural hair. Teasing is a hair care technique that can be used to increase hair volume, but hair will typically fall back into place after being teased, requiring additional teasing. Such teasing can damage hair, and is therefore repeated teasing is not desirable. Hair volumizer 102 creates an effect similar to teasing without the accompanying hair damage and lasts until the user removes hair volumizer 102.

Figure 2A:
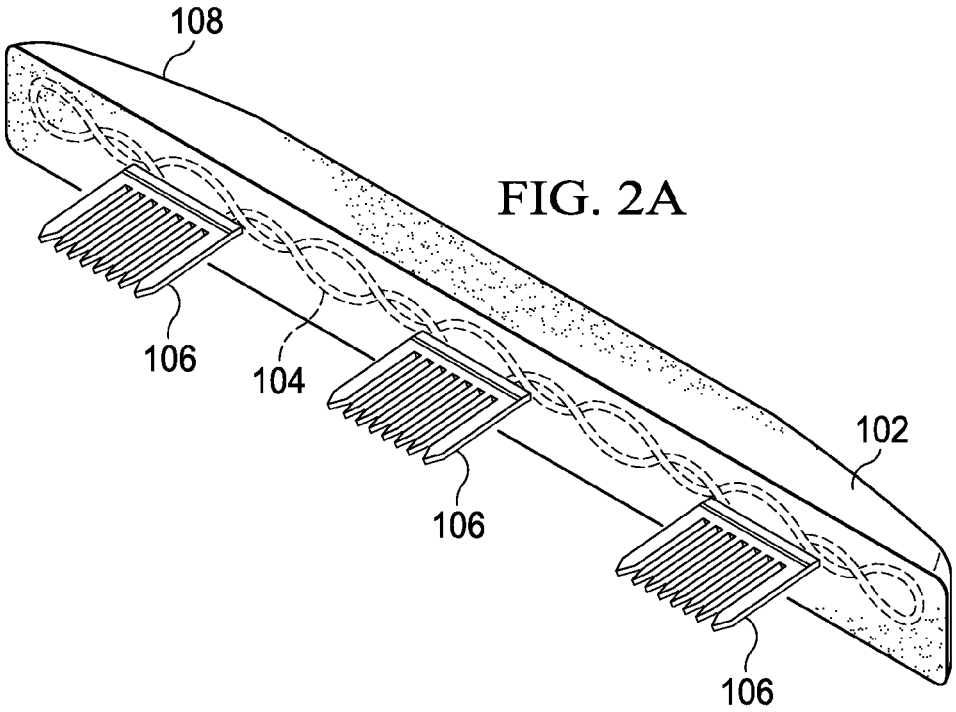
FIGS. 2A and 2B are perspective views of the hair volumizer showing a plurality of clips in accordance with an exemplary embodiment of the present disclosure.
Figure 2B:
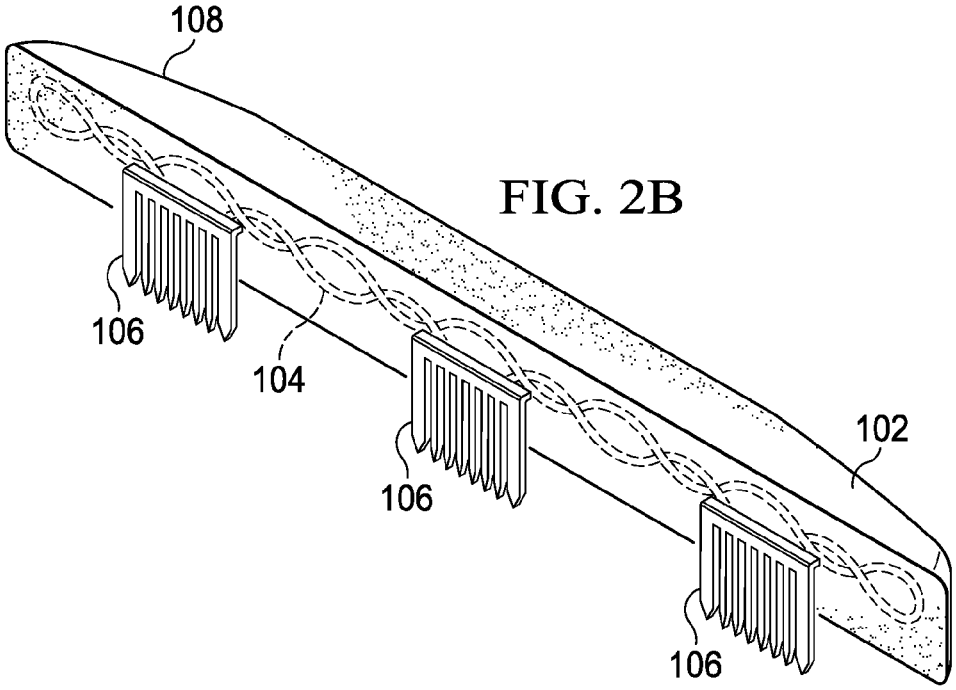

FIGS. 2A and 2B are perspective views of hair volumizer 102 showing a plurality of clips 106 in accordance with an exemplary embodiment the present disclosure. As shown in FIGS. 2A and 2B, the ends 108 of hair volumizer 102 are tapered at a suitable angle, so as to be less apparent, whereas the middle section of hair volumizer 102 is thicker, to provide additional gradual volume. The body of hair volumizer 102 is formed from a suitable foam material, such as a polymer foam, a natural foam material such as wool or cotton, or other suitable materials. In one exemplary embodiment, the outer surface of hair volumizer 102 can be wrapped in natural hair, such as from the person using hair volumizer 102, so as to provide an exact match with the color of the user's hair, or using hair from other natural or artificial sources. The outer surface of hair volumizer 102 can also be treated to receive hair coloring dye, so as to allow a user to match the color of the outer surface of hair volumizer 102 to the user's hair when the user's hair is dyed.

Flexible core 104 of hair volumizer 102 can be formed from wire, flexible metal strips, or other suitable materials that can be easily adapted to follow the contours of the user's head, but which are sufficiently rigid not to change shape while being worn. Clips 106 are shown in an open position in FIG. 2A and in a closed position in FIG. 2B, and can be attached to flexible core 104 or separate from flexible core 104. The use of a plurality of clips 106 and a flexible core 104 facilitates the use of hair volumizer 102, which allows the user to attach hair volumizer 102 in a series of steps, so as to allow the user to change their position relative to a mirror to better see how each section of hair volumizer is being attached and to relocate individual sections, if needed. When closed, clips 106 securely hold each section of hair volumizer 102 in position to the user's existing hair without damaging the natural hair.

Referring now to FIG. 1B, it can be seen that the configuration of hair volumizer 102 when worn follows the contours of the user's head, and that hair volumizer 102 does not need to remain straight, as shown in FIGS. 2A and 2B. As such, hair volumizer 102 can be adapted both circumferentially and laterally, to provide volume in a desired location and also to allow the user's hair to be easily styled as desired. Thus, the user can easily adjust their hair style by adjusting and relocating hair volumizer 102, as opposed to hair spray, which does not allow hair to be readily adjusted after it has been applied.

Figure 3:
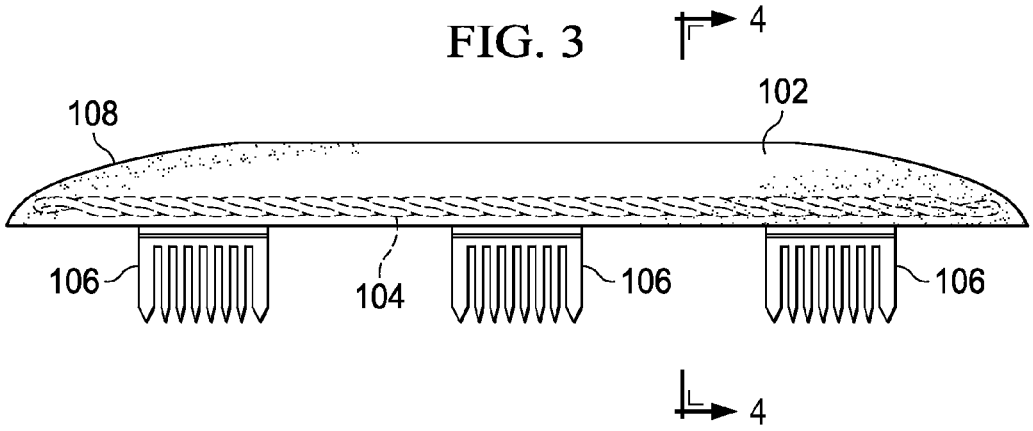
FIG. 3 is a side view of the hair volumizer showing tapered ends and clips in an open position, as well as the location of a flexible core.
Figure 4:
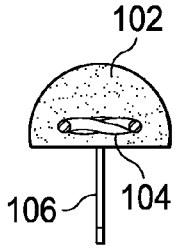
FIG. 4 is a cross-section view of the hair volumizer.

FIG. 3 is a side view of hair volumizer 102 showing tapered ends 108 and clips 106 in an open position, as well as the location of flexible core 104 (not explicitly shown). FIG. 4 is a cross-section view or hair volumizer 102 along cut line shown in FIG. 3, which shows flexible core 104 contained within the foam material body of hair volumizer 102, and clip 106 in an open position.

Figure 5A:
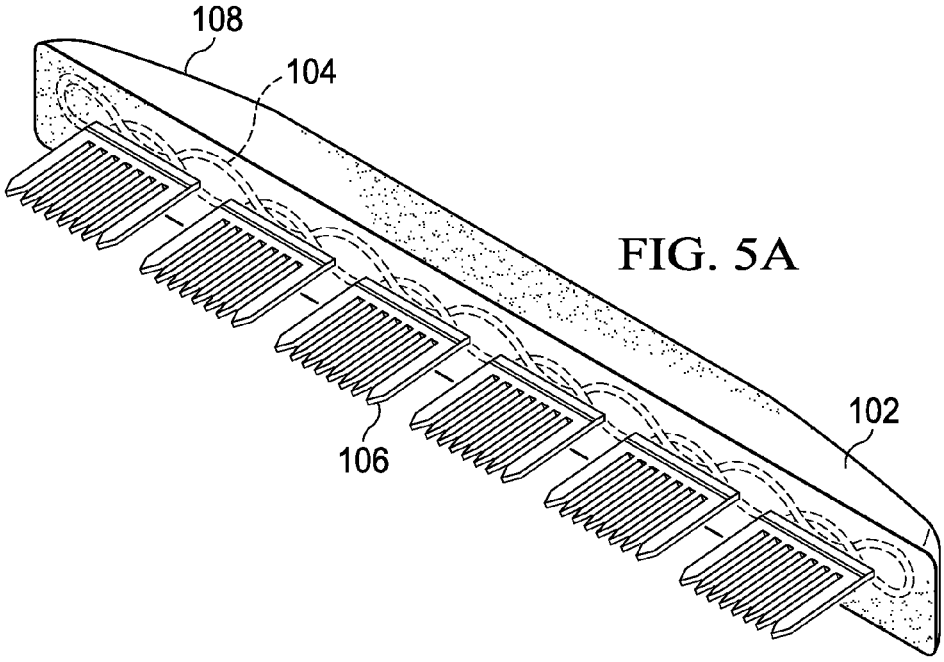
FIGS. 5A and 5B are perspective views of the hair volumizer showing a plurality of clips in accordance with another exemplary embodiment of the present disclosure.
Figure 5B:
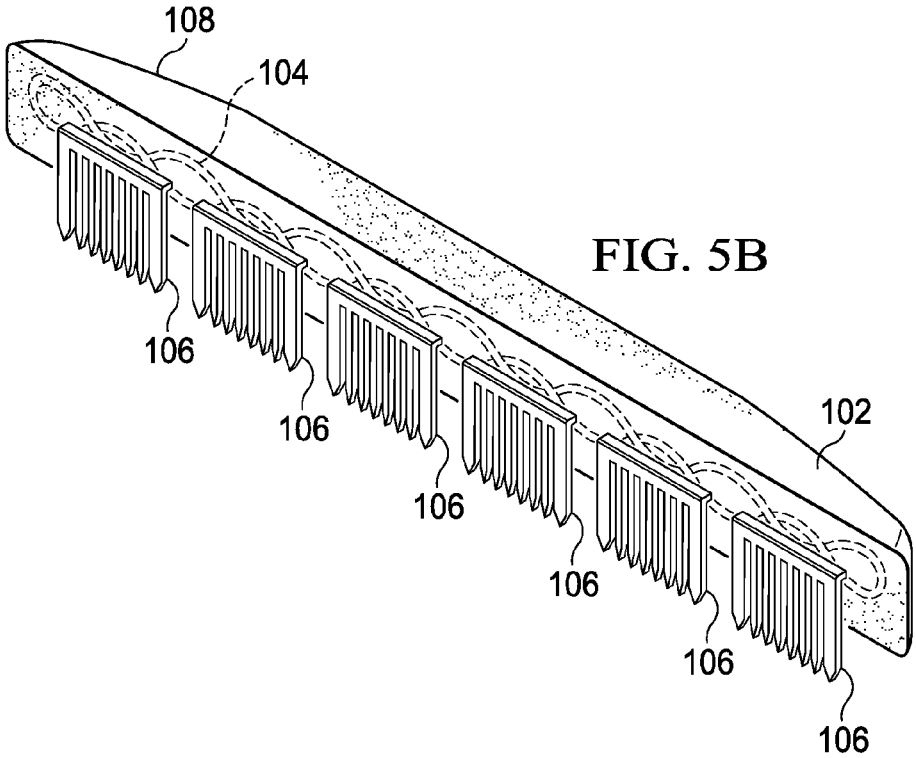
Figure 6:
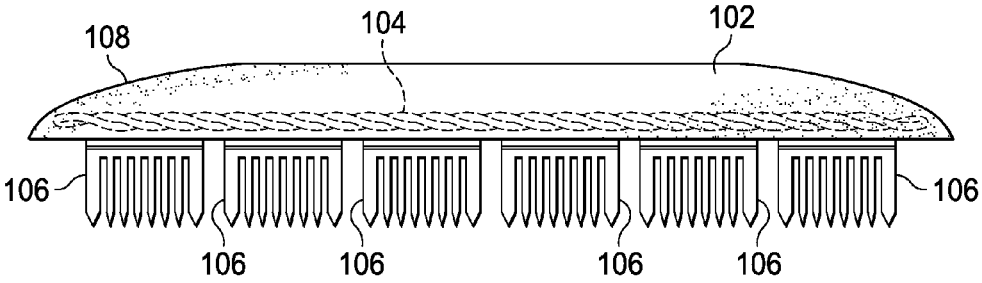
FIG. 6 is a side view of this exemplary embodiment of a hair volumizer, showing clips in an open position.

FIGS. 5A and 5B are perspective views of hair volumizer 102 showing a plurality of clips 106 in accordance with another exemplary embodiment of the present disclosure. As shown in FIGS. 5A and 5B, hair volumizer 102 can include a suitable number of clips to provide additional functionality for the placement and use of hair volumizer 102. For example, clips 106 can be used to secure sections of the user's hair in position, in addition to providing volume by virtue of the foam material body of hair volumizer 102. FIG. 6 is a side view of this exemplary embodiment of hair volumizer 102, showing clips 106 in an open position.

Figure 7A:
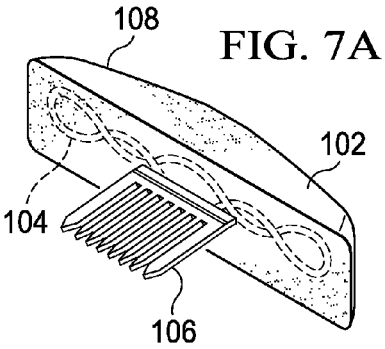
FIGS. 7A and 7B are perspective views of another exemplary embodiment of the hair volumizer in accordance with shorter exemplary embodiment of the present disclosure.
Figure 7B:
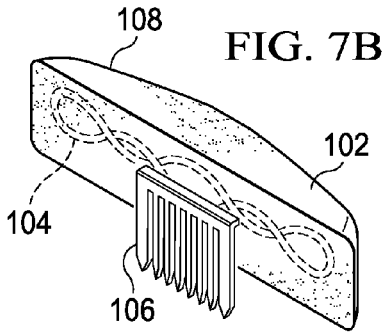
Figure 8:
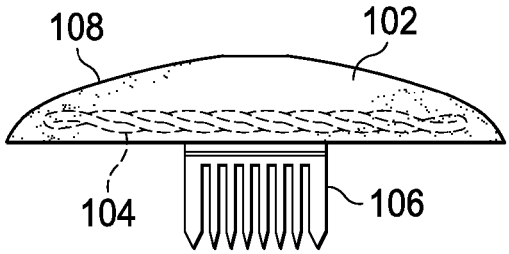
FIG. 8 is a side view of the shorter embodiment of the hair volumizer, showing the clip in an open position.

FIGS. 7A and 7B are perspective views of another exemplary embodiment of hair volumizer 102 in accordance with an exemplary embodiment the present disclosure. As shown in FIGS. 7A and 7B, hair volumizer 102 can be used in a shorter section, even properly operating with a single clip 106 or two or more clips, depending on the length of the embodiment of the hair volumizer. FIG. 7A displays the single clip embodiment, which is shown in an open configuration and in a closed configuration in FIG. 7B. FIG. 8 is a side view of the single clip embodiment of hair volumizer 102, showing clip 106 in an open position.

Figure 9:
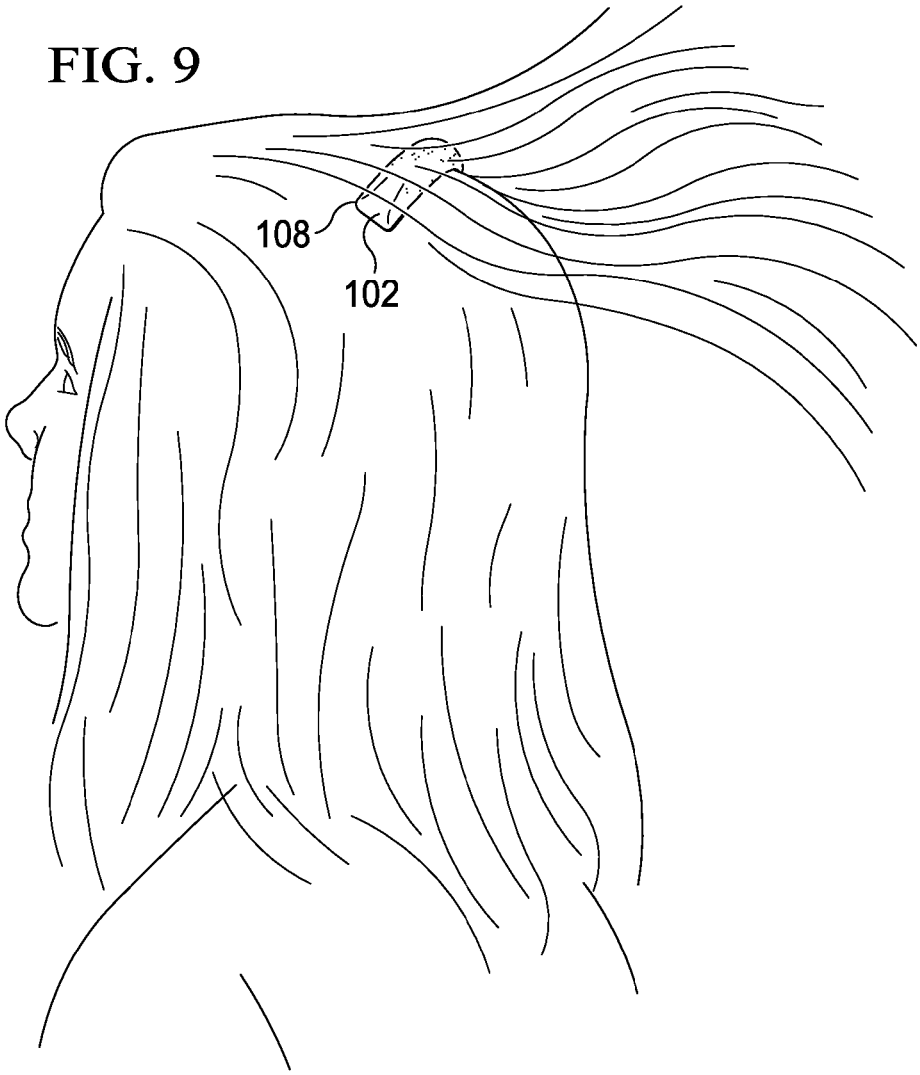
FIG. 9 is a diagram showing this shorter exemplary embodiment of a hair volumizer being placed in a different position on the user's head.

FIG. 9 is a diagram showing this shorter exemplary embodiment of hair volumizer 102 being placed in a different position on the user's head. As shown in FIG. 9, the shorter embodiment can be used in smaller sections, which provides additional stylizing flexibility. Various suitable lengths of hair volumizer 102 can be provided to aid in a plethora of hairstyles.

Hair volumizer 102 can also be combined with hair extensions, where suitable, such as to provide additional volume in conjunction with the fullness that hair extensions offer. Although the hair extensions would still need to be matched to the hair color of the user's natural existing hair, the use of hair extensions in conjunction with hair volumizer 102 can increase the ease of placement of the hair extensions and give extra volume to the hair extensions which normally fall flat due to weight It should be emphasized that the above-described embodiments are merely examples of possible implementations. Many variations and modifications may be made to the above-described embodiments without departing from the principles of the present disclosure. All such modifications and variations are intended to be included herein within the scope of this disclosure and protected by the following claims.

What is claimed is:

1. An apparatus for hair care comprising:

an elongate foam body extending along a longitudinal axis, the foam body having tapered ends;

a flexible twisted wire core embedded centrally within the foam body and extending the length of the body along the longitudinal axis;

a plurality of clips attached centrally on a face of the foam body and aligned along the longitudinal axis, each of the plurality of clips having an open position and a closed position where the clip body is flush with the foam body in the closed position, and in the open position a portion of the clip is pivoted to a space distant from the foam body;

wherein the foam body is configured to be placed underneath a user's natural hair and to be covered by the user's natural hair when secured in position by the plurality of clips; and wherein the flexible core is configured to be adapted to a contour of the user's head.

2. The apparatus of claim 1 wherein the plurality of clips and the flexible core are configured to provide for lateral and circumferential placement of the foam body at two or more user-selected locations.

3. The apparatus of claim 1 wherein the foam body is wrapped in natural hair.

4. The apparatus of claim 1 further comprising a hair extension coupled to the foam body and configured to be layered with the user's natural hair.

5. The apparatus of claim 1 wherein the clip is coupled to the flexible core.

6. The apparatus of claim 1 wherein the foam body is covered in a surface that can be colored using conventional hair dye.

7. A method of hair care comprising:

providing a clip comprising: an elongate foam body extending along a longitudinal axis, the foam body having tapered ends; a flexible twisted wire core embedded centrally within the foam body and extending the length of the body along the longitudinal axis;

a plurality of clips attached centrally on a face of the foam body and aligned along the longitudinal axis, each of the plurality of clips having an open position and a closed position where the clip body is flush with the foam body in the closed position, and in the open position a portion of the clip is pivoted to a space distant from the foam body; raising a lock of hair from a user's head to a raised position;

positioning a first clip of an elongate foam body having tapered ends at a location underneath the raised lock of hair;

attaching the first clip when the first clip is correctly positioned;

adjusting a flexible core of the elongate foam body to fit the elongate foam body to a contour of the user's head; and returning the lock of hair to a resting position, wherein the lock of hair essentially covers the elongate foam body so that it is not readily visible.

8. The method of claim 7 further comprising:

positioning a second clip of the elongate foam body at a second location underneath the raised lock of hair; and attaching the second clip when the second clip is correctly positioned.

9. The method of claim 7 further comprising:

adjusting the flexible core of the elongate foam body circumferentially so as to position a second clip of the elongate foam body at a second location underneath the raised lock of hair; and attaching the second clip when the second clip is correctly positioned.

10. The method of claim 7 further comprising:

adjusting the flexible core of the elongate foam body circumferentially and laterally so as to position a second clip of the elongate foam body at a second location underneath the raised lock of hair; and attaching the second clip when the second clip is correctly positioned.

11. The method of claim 10 further comprising:

further adjusting the flexible core of the elongate foam body circumferentially and laterally so as to position a third clip of the elongate foam body at a third location underneath the raised lock of hair; and attaching the third clip when the third clip is correctly positioned.

12. The method of claim 7 further comprising:

raising a second lock of hair from the user's head to a second raised position;

positioning a second clip of the elongate foam body at a second location underneath the second raised lock of hair; and attaching the second clip when the second clip is correctly positioned.

13. The method of claim 7 further comprising:

raising a second lock of hair from the user's head to a second raised position;

adjusting the flexible core of the elongate foam body circumferentially so as to position a second clip of the elongate foam body at a second location underneath the second raised lock of hair; and attaching the second clip when the second clip is correctly positioned.

14. The method of claim 7 further comprising:

raising a second lock of hair from the user's head to a second raised position;

adjusting the flexible core of the elongate foam body circumferentially and laterally so as to position a second clip of the elongate foam body at a second location underneath the second raised lock of hair; and attaching the second clip when the second clip is correctly positioned.

15. The method of claim 14 further comprising:

raising a third lock of hair from the user's head to a third raised position;

further adjusting the flexible core of the elongate foam body circumferentially and laterally so as to position a third clip of the elongate foam body at a third location underneath the third raised lock of hair; and attaching the third clip when the third clip is correctly positioned.

* * * * *